US005583398A

United States Patent [19]

Dellamano et al.

[11] Patent Number: 5,583,398

[45] Date of Patent: Dec. 10, 1996

[54] POWERFACTOR CORRECTING FLYBACK ARRANGEMENT HAVING A RESONANT CAPACITOR ELEMENT CONNECTED ACROSS THE SWITCHING ELEMENT

[75] Inventors: Harry A. Dellamano, Thousand Oaks; Andrew P. Kisylia, Agoura Hills, both of Calif.

[73] Assignee: MagneTek, Inc., Nashville, Tenn.

[21] Appl. No.: 306,499

[22] Filed: Sep. 15, 1994

[51] Int. Cl.[6] ..... H05B 37/02

[52] U.S. Cl. ..... 315/247; 315/224; 315/DIG. 4; 315/307

[58] Field of Search ..... 315/247, 307, 315/224, DIG. 4

[56] References Cited

U.S. PATENT DOCUMENTS

| | | | |
|---|---|---|---|
| 4,251,752 | 2/1981 | Stolz | 315/247 |
| 4,277,728 | 7/1981 | Stevens | 315/247 |
| 5,397,965 | 3/1995 | Gorille et al. | 315/247 |

*Primary Examiner*—Robert Pascal
*Assistant Examiner*—Michael Shingleton
*Attorney, Agent, or Firm*—Seldon & Scillieri

[57] ABSTRACT

A preferred embodiment of the present invention provides a ballast circuit, comprising three sections: an input power section that receives a line AC signal as an input and provides a DC signal as an output; a pre-regulator section that conditions the DC signal; and a lamp driver section that drives a gas discharge lamp load. The pre-regulator section includes a transformer with an input winding, an output winding, and a current sense winding. The input winding receives the DC signal provided by the input power section. The output winding is connected in a flyback configuration with a flyback blocking diode, a bulk storage capacitor, and an output terminal for the conditioned DC signal. The current sense winding generates a signal proportional to the level of the transformer current. The transformer current is controlled by a flyback switch. A resonant capacitor is connected between the flyback switch input and ground, the resonant capacitor and the transformer forming a resonant circuit. A controller actuates the flyback switch, receiving as an input the current level signal and generating as an output a pulse voltage to the gate terminal of the flyback switch. The controller actuates the flyback switch at a predetermined time after the current level signal indicates zero transformer current, coinciding with the timing of the resonant circuit such that the switching means turns on when there is zero voltage across it.

7 Claims, 7 Drawing Sheets

B1
B2
B3
FLOBULB
FLOBULB
FLOBULB
L4
22101A
1mH
L5
22101A
1mH
L6
22101A
1mH
C32
4.7nF
C30
4.7nF
C23
4.7nF
C25
1nF
600V
.25W
C27
.33µF
250V
C26
1nF
600V
R30
510k
Q2
IR743
Q3
IR743
POS DRV
R23
30
R24
30
DC 1002
U3
U2
DC 1001
VDD
NC
OUT
COM
HD1
HD2
CT
RT
C24
100V
0.47µF
R31
30
D0
A114D
+15VDV
C21
0.1µF
C22
600pF
R32
56.2k
R35
25k

POWERFACTOR CORRECTING FLYBACK ARRANGEMENT HAVING A RESONANT CAPACITOR ELEMENT CONNECTED ACROSS THE SWITCHING ELEMENT

BACKGROUND OF THE INVENTION

1. Technical Field

The present invention relates generally to the field of control circuits, and in particular to dimming ballast circuits used to drive gas discharge lamps.

2. Background Art

In prior art ballast circuits, a variety of approaches have been used to maintain a particular level of light intensity and to effect dimming, including lamp current sensing and the use of variable frequencies. However, these prior art approaches suffer from known disadvantages, relating to manufacturing costs and performance considerations. There is thus a long-felt need in the art for a low-cost, high-performance ballast circuit, such as that provided by the present invention.

SUMMARY OF THE INVENTION

A preferred embodiment of the present invention provides a ballast circuit, comprising three sections: an input power section that receives a line AC signal as an input and provides a DC signal as an output; a pre-regulator section that conditions the DC signal; and a lamp driver section that drives a gas discharge lamp load.

The pre-regulator section includes a transformer with an input winding, an output winding, and a current sense winding. The input winding receives the DC signal provided by the input power section. The output winding is connected in a flyback configuration with a flyback blocking diode, a bulk storage capacitor, and an output terminal for the conditioned DC signal. The current sense winding generates a signal proportional to the level of the transformer current.

The transformer current is controlled by a flyback switch. A resonant capacitor is connected between the flyback switch input and ground, the resonant capacitor and the transformer forming a resonant circuit. A controller actuates the flyback switch, receiving as an input the current level signal and generating as an output a pulse voltage to the gate terminal of the flyback switch. The controller actuates the flyback switch at a predetermined time after the current level signal indicates zero transformer current, coinciding with the timing of the resonant circuit such that the switching means turns on when there is zero voltage across it.

DESCRIPTION OF SPECIFIC EMBODIMENTS

The present invention provides a dimming ballast circuit for driving gas discharge lamps. The circuit includes three sections: (1) an input power section, which provides a direct interface to a line voltage, e.g., 120 V AC; (2) a pre-regulator section, which provides a highly regulated DC voltage while providing high power factor correction and low harmonic distortion on the input current; and (3) a lamp driver section.

The operation of the ballast circuit is based on the fact that the lamp driver section presents a fixed load to the DC voltage produced by the pre-regulator section. Therefore, at any fixed voltage level, the output power VxI of a lamp, and therefore its light output, remains constant. It is only necessary to regulate the voltage to the lamp driver section to maintain a particular level of light intensity. Dimming is accomplished by varying from an external control source the output voltage of the pre-regulator section. In the present embodiment, the lamp drive voltage ranges from a high value of approximately 300 V DC, corresponding to maximum brightness, to a low value of 50 V DC, corresponding to minimum brightness. No attempt is made to sense the lamp current, as it is not necessary.

Figure 1:
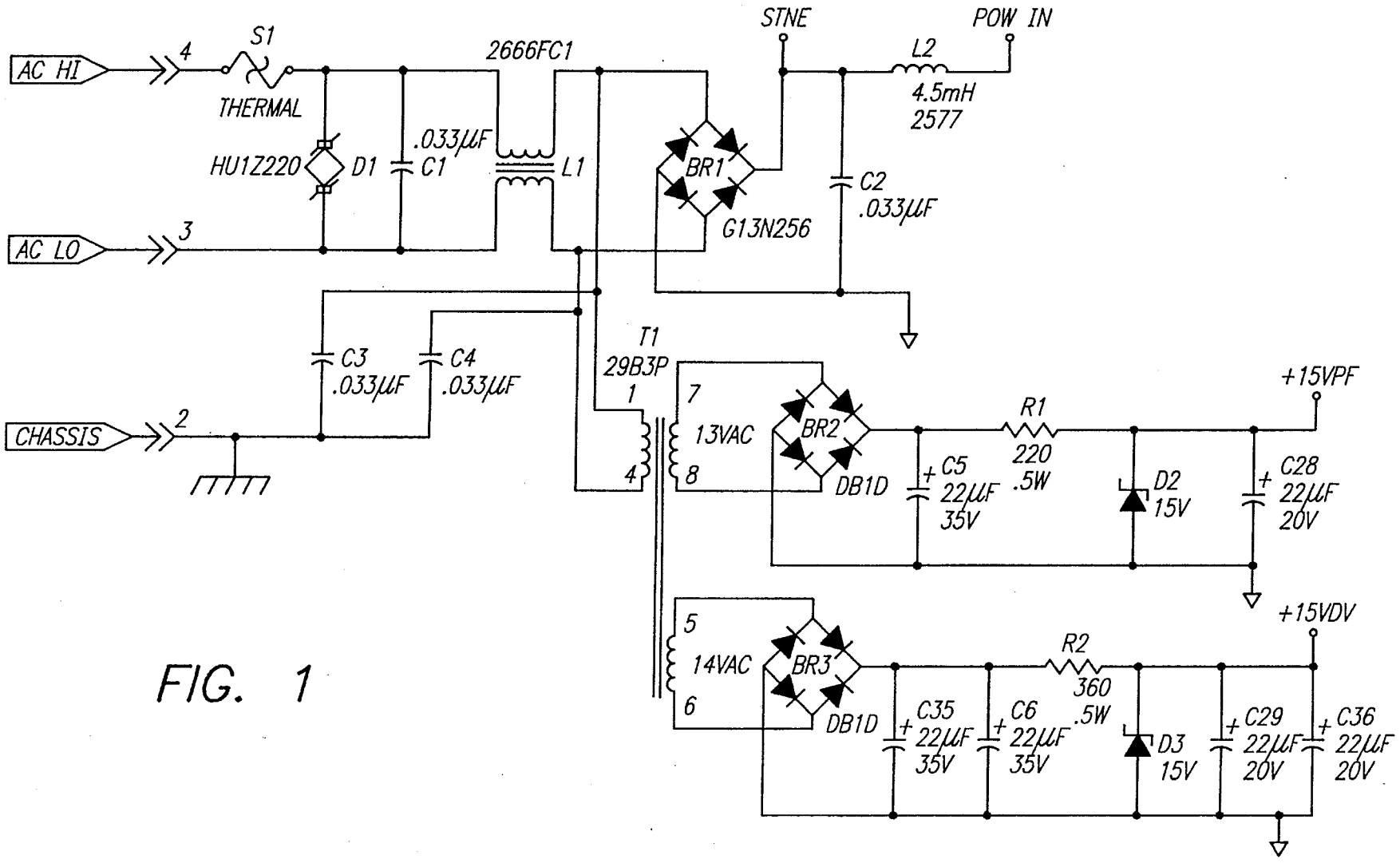
FIG. 1 shows a circuit diagram of a preferred embodiment of an input power section according to the present invention.

FIG. 1 shows a circuit schematic of a preferred embodiment of an input power section according to the present invention. The input power section receives a standard 120 V AC input at connectors 3 and 4, and generates the following DC outputs: SINE, POW IN, +15 VPF, and +15 VDV. As described further below, these outputs are fed to various points in the FIG. 2 pre-regulator section and the FIG. 3 lamp driver section.

The AC line input is fed to tranzorb D1, which protects the ballast circuitry from line voltage transient spikes. Common mode choke L1, and high-voltage filter capacitors C1, C3, and C4 provide filtering for conducted EMI to the line. The circuit is grounded to the ballast chassis via connector 2.

Full-wave bridge rectifier BR1 is used to create outputs SINE and POW IN. The SINE output, which is used by the controller integrated circuit in the FIG. 2 pre-regulator section for fine correction to the power factor, is taken directly from the unfiltered output of rectifier BR1. The POW IN output, which is the main input to the FIG. 2 pre-regulator section, is taken from the output of rectifier BR1 after low-pass filtering by capacitor C2. Inductor L2 serves as a current line filter to block the transients caused by the flyback inductance within the FIG. 2 pre-regulator section.

Figure 2:
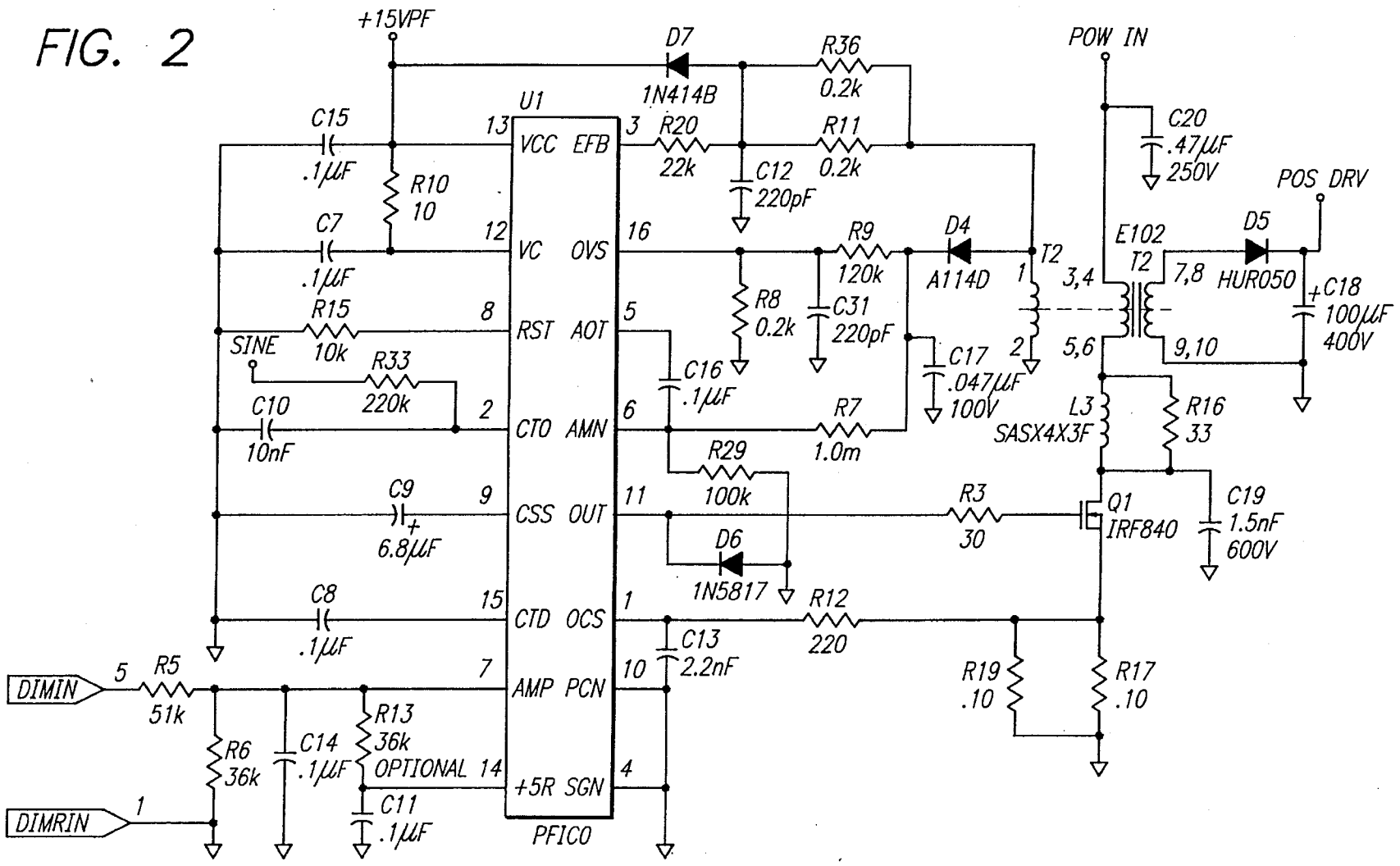
FIG. 2 shows a circuit diagram of a preferred embodiment of a pre-regulator section according to the present invention.
Figure 3:
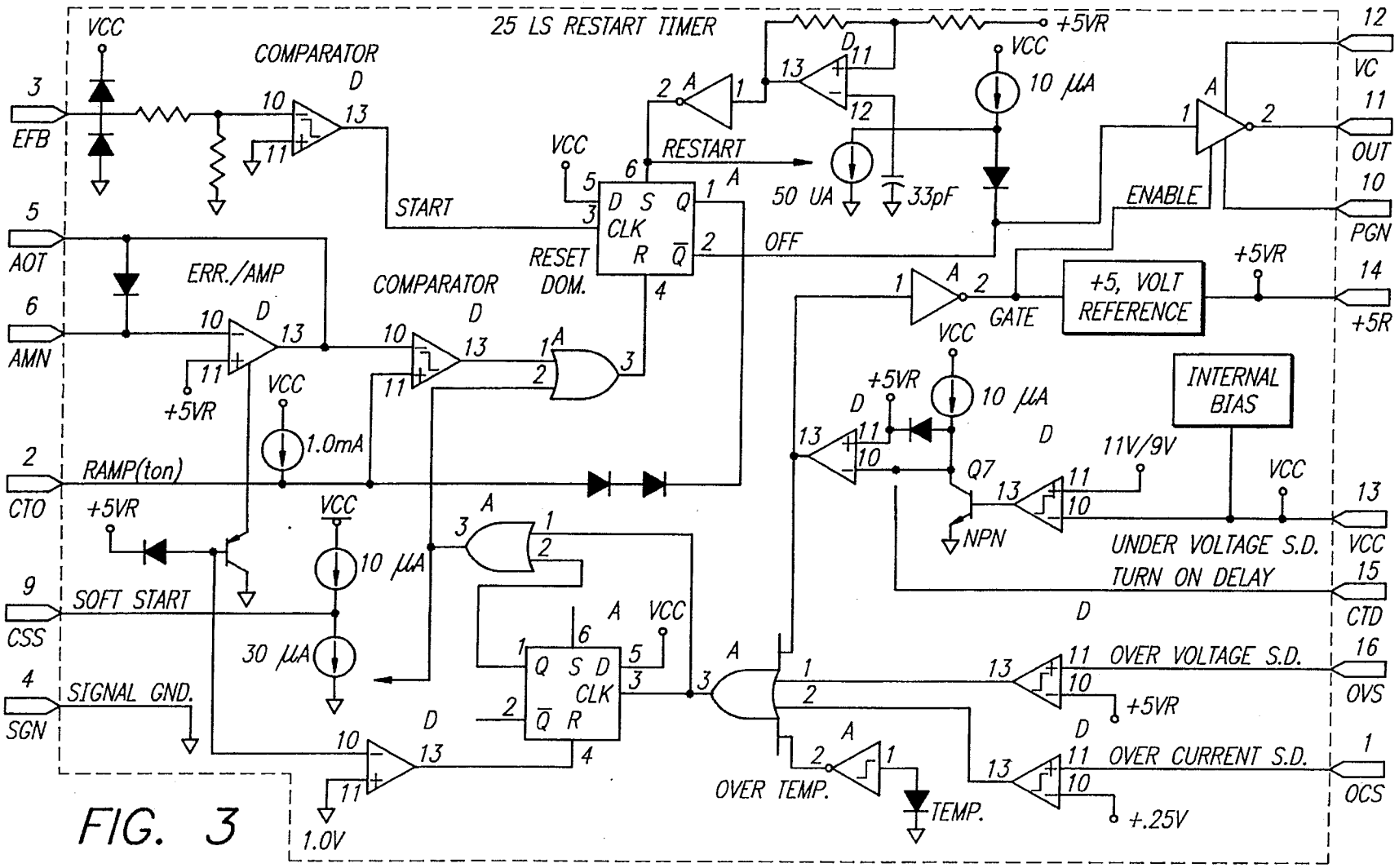
FIG. 3 shows a circuit diagram of a preferred embodiment of the controller integrated circuit shown in the FIG. 2 circuit.

Both the FIG. 2 pre-regulator section and the FIG. 3 lamp driver section require external DC bias supply voltages for operation. Because these sections do not operate from the same reference, the bias supplies must be generated separately. Thus, the FIG. 1 input power section provides two additional rectifiers BR2 and BR3 and associated circuitry.

Transformer T1 provides voltage step-down and isolation for both supplies. Full-wave bridge rectifier BR2, filters C5 and C28, resistor R1, and Zener diode D2 generate the nominal 15 V DC bias +15 VPF for the FIG. 2 pre-regulator section. Full-wave bridge rectifier BR3, filters C35, C6, C29, and C36, resistor R2, and Zener diode D3 generate the nominal 15 V DC bias +15 VDV for the FIG. 3 lamp driver section.

FIG. 2 shows a circuit diagram of a preferred embodiment of a ballast circuit pre-regulator section according to the present invention. The pre-regulator section provides a highly regulated, fixed (at a specific dimming level) DC voltage POS DRV for the FIG. 3 lamp driver section, while providing high power factor correction and low harmonic distortion on the input current. The input to the pre-regulator section is the low-pass filtered, full-wave rectified output POW IN of the FIG. 1 input power section.

As shown in FIG. 2, the pre-regulator section operates as a "flyback" or "buck-boost" converter, consisting of a power electronics subsection between POW IN and POS DRV, shown on the right side of the schematic, and a control subsection, shown on the left side of the schematic. The range of the DC voltage output of the pre-regulator needed for dimming precludes the use of either a "boost" or a "buck" type of regulator.

In the power electronics subsection, capacitor C20 filters the transients caused by the flyback inductance of transformer T2. Diode D5 is the flyback blocking diode. Capacitor C18 is a bulk storage filter for the output voltage POS DRV.

Transformer T2 has three windings: an input winding, an output winding, and a sense winding. In the present preferred embodiment, the input and output windings are wound in a one-to-one ratio, and the input and sense windings are wound in a five-to-one ratio. The input winding provides the flyback storage inductance. The transformer formed by the input and output windings provides input-to-output isolation. The sense winding is used to detect a zero-current condition in the transformer, and is also used to develop signals proportional to the output voltage POS DRV to regulate and vary the output voltage.

HEXFET Q1 is the flyback switch. Amorphous inductor L3 and resistor R16 form a low-low snubber to limit the turn-on ringing of the HEXFET. Resistors R19 and R17 provide a low-resistance current sense for the over-current sense input at pin 1 of controller U1. Capacitor C19 forms a resonant circuit with transformer T2. The relatively large value chosen for capacitor C19 renders insignificant any parasitic capacitance displayed by HEXFET Q1.

Figure 4A:
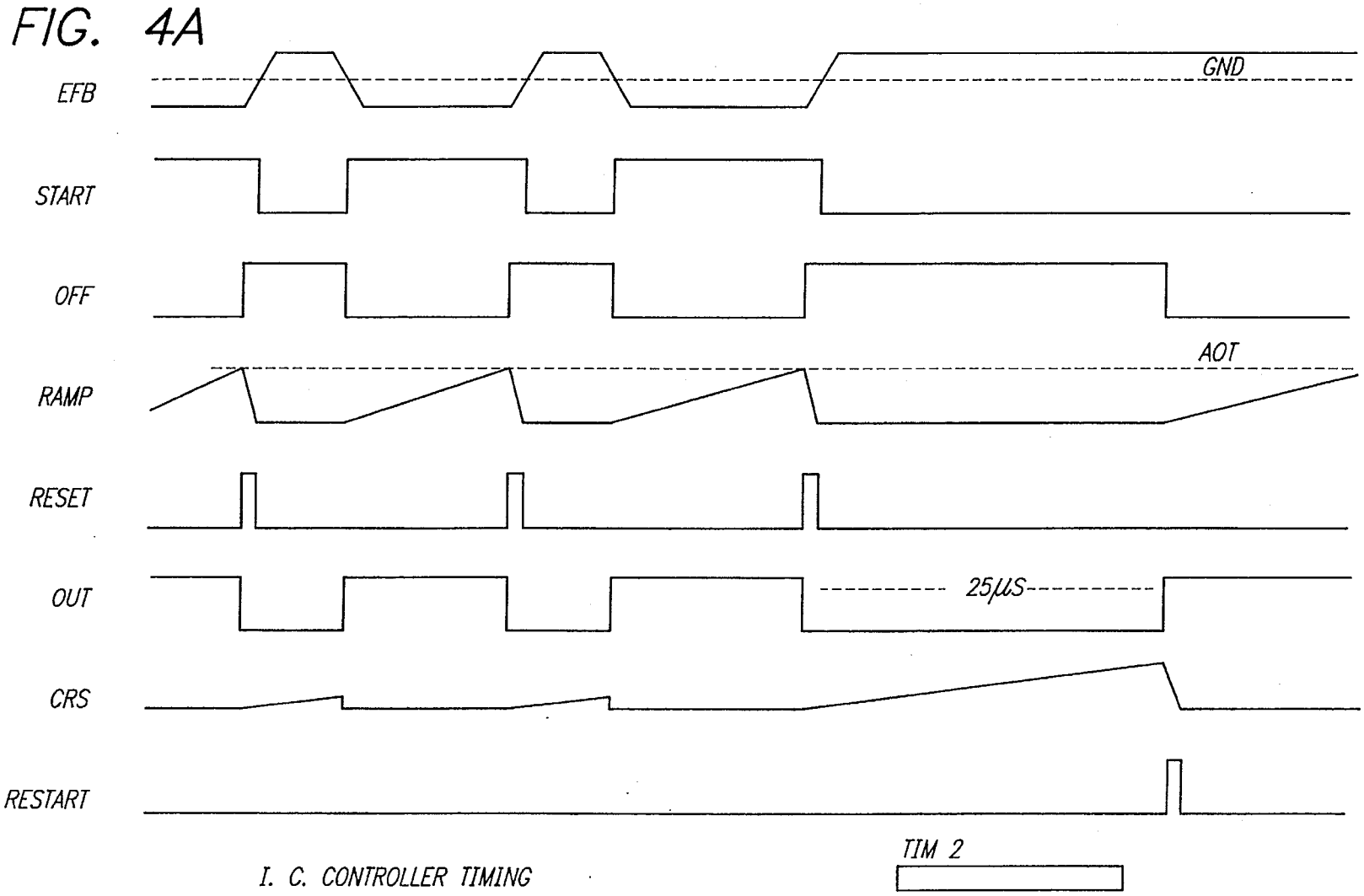
FIGS. 4A and 4B show timing diagrams of the controller integrated circuit shown in FIG. 3.
Figure 4B:
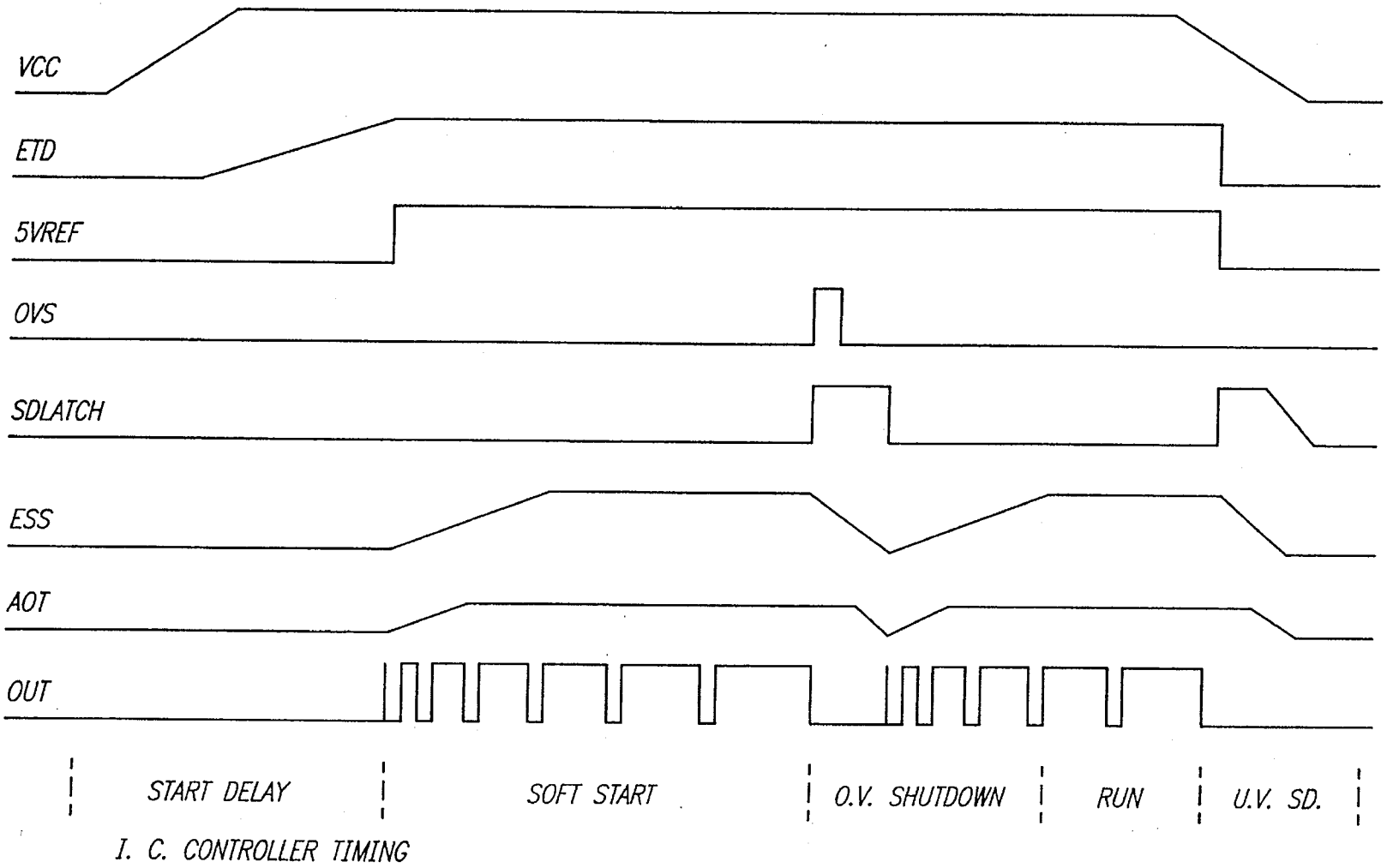

The core of the pre-regulator control subsection, shown at the left of FIG. 2, is controller U1, which in the present preferred embodiment is a Magnetek proprietary custom Pre-regulator/Power Factor Controller integrated circuit PFICB. The following description of controller U1 can better be understood with reference to FIG. 3, which is a circuit diagram showing the internal operation of the controller, and FIGS. 4A and 4B, which are controller timing diagrams.

Controller U1 operates the flyback circuit in a "critical current switching" mode of operation, in combination with the resonant circuit formed by transformer T2 and capacitor C19. The current in the flyback inductor is not allowed to fall to zero. The zero-current condition is sensed by the circuit, and the next flyback cycle is started, i.e., HEXFET Q1 is turned "on." This insures that the "peak" flyback currents are kept as low as possible. The flyback circuit also functions in a zero-voltage switching mode, switching HEXFET Q1 "on" and "off" when the voltage across capacitor C19 (and HEXFET Q1) is zero. Zero-voltage switching provides for low-power and low-noise switching.

The controller turns HEXFET Q1 "on" by sending a pulse voltage from pin 11 OUT, which is the output of a high-current power driver, to drive the HEXFET gate. Series damping resistor R3 is included between pin 11 OUT and the HEXFET gate to reduce ringing. Schottky diode D6 prevents damage to the controller arising from a negative voltage spike. A pulse voltage is generated at pin 11 OUT when the controller senses a "zero-current" signal at pin 3 EFB, indicating zero current flow through transformer T3.

Pin 3 EFB detects the "zero-current" condition within the flyback inductance of transformer T2 via the transformer sense winding. As the current falls to zero and, due to the resonant circuit formed by capacitor C19 and transformer T2, begins to reverse, the voltage induced in the sense winding falls below SGN, the signal reference ground at pin 4 for all functions on the device. This condition is detected in the controller's internal fast comparator, and the resulting start edge turns on the device's start flip-flop.

The start is delayed (the minimum delay specified in the device specification) to coincide with the resonant turn-on of the parasitic diode within Q1 due to the reverse current in the inductance of transformer T2. This insures that Q1 turns on when there is zero voltage from source to drain.

At low values of POS DRV, e.g., in dimming conditions, and at low points of the SINE input signal at pin 2 CTO, it is possible that the sensed voltage may not fall below the signal reference ground SGN and, therefore, a start edge would not be produced. To provide operation under these conditions, an internal 45 μs restart timer is provided.

The network formed by resistors R11, R36, and R20, capacitor C12, and diode D7 differentiates, filters and scales the sense voltage for the input to pin 3 EFB. Diode D7 limits the peak at 15 VPF and feeds charging current from the sense winding to the bias supply.

The pin 2 CTO input provides a linear ramp for comparison in the controller's internal ramp comparator with the output of the controller's internal error amplifier. The point at which the ramp voltage at pin 2 CTO exceeds the error amp output defines the "on-time" of the pulse voltage output at pin 11 OUT, and thereby the "on-time" of the gate of HEXFET Q1 and the charging time of the inductance of transformer T2.

Capacitor C10 connected from pin 2 CTO to ground defines the ramp charge rate. Capacitor C10 is charged from a ~10 mA current source. This internal current source is externally modified by resistor R33, which supplies an additional charging current proportional to the instantaneous magnitude of the input rectified, unfiltered SINE signal. This is a fine correction to the power factor. It results in a higher slope at the SINE peak (shorter "on-time") and a lower slope at the SINE valley (longer "on-time"). The ramp at CTO charges between a minimum of $2xE_dV$ and a maximum of $+5V_{REF}+2XE_dV$.

Once the on-time has elapsed, the OUT voltage goes low, thereby switching HEXFET Q1 off. Even after the HEXFET is switched off, transformer T2 tends to cause current to continue to flow. Sudden voltages thus developed at HEXFET Q1 could result in component damage. However, this situation is prevented by the presence of resonant capacitor C19. When the HEXFET is switched off, current instantaneously flows to capacitor C19 until the next flyback cycle.

The voltage of POS DRV is regulated by the controller's internal over-voltage shutdown function. The over-voltage shutdown function internally compares the voltage at the pin 16 OVS input with the internal reference voltage $+5V_{REF}$. When the input exceeds $+5V_{REF}$, the device is placed in the controller's soft-start sequence, and will attempt to restart its operation. The network made up of diode D4, capacitor C17, resistor R9, capacitor C31, and resistor R8, based on input from the sense winding of transformer T2, provides a filtered and scaled version of pre-regulator output voltage POS DRV for over-voltage shutdown comparison at pin 16 OVS.

The controller's internal error amplifier is used to effect dimming. Pin 6 AMN is the negative input to the error amplifier. A voltage proportional to POS DRV is provided as an input to pin 6 AMN by the sense winding of transformer T2 via the network of diode D4, capacitor C17, and resistors R7 and R29. The error amplifier output at pin 5 AOT is coupled as feedback to pin 6 AMN through resistor R14 and capacitor C16. The output of the error amplifier is compared to the voltage ramp input at pin 2 CTO in the controller's internal ramp comparator. This sets the $T_{ON}$ of the gate drive.

Pin 7 AMP is the positive input to the controller's internal error amplifier. The dimming input to the ballast is fed to the controller U1 through pin 7 AMP via the voltage divider network consisting of resistors R5, R6, and R13. This sets the nominal voltage level for POS DRV. The $+5V_{REF}$ connection at pin 14 is used to provide a stable dimming signal for input to pin 7 AMP. Resistor network R5-R6-R13 acts as a voltage divider to translate the 0–10 V dimming input between signals DIMIN and DIMRTN to the 0–5 V device input at pin 7 AMP. AMP is bypassed to ground by capacitor C14.

Pin 9 CSS provides a "soft-start" capability within controller U1. Timing capacitor C9 is installed between pin 9 CSS and ground. During normal power-up or after any shut-down condition, the internal soft-start flip-flop is set. This activates a ~30 μA current sink which discharges the soft-start capacitor C9 and disables the error amp so that its output is clamped lower that any ramp valley voltage to prevent the start flip-flop turn-on, and therefore hold the output at pin 11 OUT low.

As the voltage at pin 9 CSS falls past one diode drop $E_d$, the soft-start flip-flop is reset. The ~30 μA current sink is turned off, and the soft-start capacitor C9 begins to charge from a —~10 μA current source, providing a linear voltage ramp at pin 9 CSS. As the voltage at pin 9 CSS increases, the voltage at the output of the error amp linearly ramps to its operational value. Therefore, the $T_oN$ and the duty cycle of the output at pin 11 OUT drive ramps in proportion to the voltage at pin 9 CSS. This results in a linear ramp-up of the pre-regulator output voltage POS DRV.

Pin 1 OCS is the input to the over-current shutdown function, which internally compares the voltage at pin 1 OCS to the controller's internal +0.5 V reference. When this input exceeds +0.5 V, the device is placed in the soft-start sequence and will attempt to restart its operation. The voltage sensed at pin 1 OCS is proportional to the maximum current through the flyback switch, HEXFET Q1. This is provided by the voltage across the approximately 0.05 Ω of resistance provided by the parallel combination of resistors R17 and R19 referenced to the controller's power ground PGN at pin 10. Resistor R12 and capacitor C13 provide a filter for the pin 1 OCS input.

Pin 13 $V_{cc}$ is the logic and control power connection. The value of $V_{cc}$ is nominally +15 V DC. Internally, the device is capable of functioning at a $V_{cc}$ below 9 volts. However, $V_{cc}$ is sensed internally for under-voltage shutdown. With $V_{cc}$ below 9 V, the device is inactive, and the OUT signal at pin 11 is held active low. The controller's internal UVLO comparator has 2 V of hysteresis. As $V_{cc}$ falls, UVLO takes effect at approximately 9 V, and holds the device inactive down to $V_{cc}$=2.5 V. As the voltage at $V_{cc}$ rises, UVLO remains active low until $V_{cc}$ reaches approximately 11 V. The source for $V_{cc}$ is +15 VPF from the FIG. 1 input power section bias supply. To minimize noise at this pin, capacitor C15 bypasses $V_{cc}$ to ground.

Pin 15 CTD provides a programmable turn-on delay from the time that $V_{cc}$ has passed its "rise" threshold, approximately 11 V, out of under-voltage shutdown, and the beginning of the "softstart" ramp-up. During the turn-on delay, the device is powered, but held in an active state with OUT low. The delay results from the internal comparison of a linear voltage ramp at CTD to the controller's internal reference voltage +5 $V_{REF}$. When the voltage exceeds +5 $V_{REF}$, soft-start begins. The linear ramp is produced by placing a timing capacitor C8 between CTD and ground. CTD provides a charge current source between 7.5 μA and 12.5 μA.

Pin 12 $V_c$ is the connection for the supply voltage source for the high current output driver used to drive the gate of HEXFET Q1. $V_c$ is externally connected to $V_{cc}$ by resistor R10, a 10 Ω damping resistor. To minimize noise at this pin, capacitor C7 bypasses $V_c$ to ground.

$V_c$ current is the sum of the active device supply current and the average HEXFET drive current. Knowing the maximum operating frequency and the HEXFET gate charge $Q_g$, the average drive current can be estimated by the following formula:

$$I_{drive}=Q_g \times F$$

Pin 4 SGN is the signal reference ground for all functions on the device, and pin 10 PGN is the power ground for the internal driver OUT that drives the gate of the flyback HEXFET. Care must be taken in the printed circuit board layout to minimize noise and ground loops.

Pin 14 +5 $V_{REF}$ provides a precision +5 V reference. The reference is functional when $V_{cc}$ is between +10 V and +15 V. When the circuit is in under-voltage shutdown mode, +5 $V_{REF}$ is clamped to signal reference ground SGN. Pin 14 is bypassed to ground by capacitor C11.

Pin 8 RST draws current through an external reference resistor R15 to ground. It sets the value of the internal bias and, therefore, all internal current sources.

From the above description, it will be appreciated that controller U1 provides numerous protection and recovery functions. All the following device functions de-activate the operation of the chip and hold the output at pin 11 OUT low: under-voltage shutdown; over-voltage shutdown; over-current shutdown; and over-temperature shutdown. The turn-on recovery from under-voltage shutdown is the same sequence as for normal power-up. The device passes first through its turn-on delay, and then rises through the soft-start ramp delay. Recovery from over-voltage shutdown, over-current shutdown, and over-temperature shutdown do not pass through the turn-on delay time out. The device only rises through the soft-start ramp delay. After the recovery attempt, if the shutdown condition is still present, the device will shut down and cycle up again.

Figure 5:
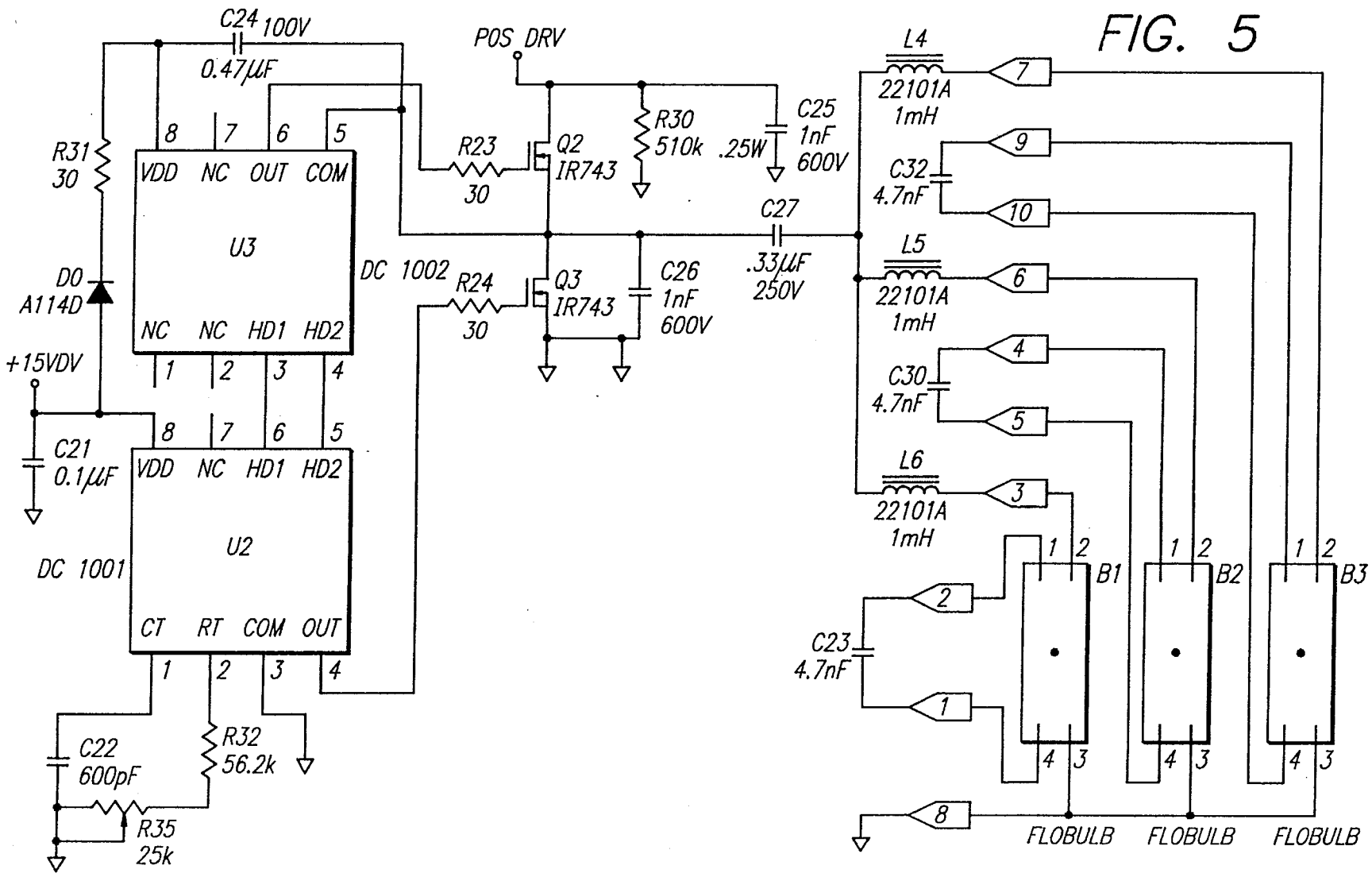
FIG. 5 shows a circuit diagram of a preferred embodiment of a lamp driver section according to the present invention.

FIG. 5 shows a preferred embodiment of an output lamp driver section according to the present invention. The lamps B1, B2, and B3 are directly driven in parallel by a half-bridge driver circuit comprising two HEXFETs, Q2 and Q3, arranged as high-side and low-side switches. The half-bridge driver includes a capacitor C26 connected between the lamp side of the bridge and ground for zero-voltage switching. The timing and the gate drive for both the high-side and low-side HEXFETs are provided by a pair of driver integrated circuits, a DC1001 low-side driver U2, and a DC1002 high-side driver U3.

The FIG. 5 lamp driver section of the circuit is isolated from the FIG. 2 pre-regulator section; all timing for the lamp driver section is generated within the lamp driver section independent of the pre-regulator section. The lamp driver section is powered by isolated bias supply +15 VDV. At turn-on, as POS DRV ramps up linearly with the pre-regulator section soft-start, the lamp drive voltage ramps up in a similar fashion. The lamp drive frequency is generated in the DC1001 low-side driver U2. In the present preferred embodiment, the drive frequency chosen is approximately 74 kHz.

Each lamp B1, B2, B3 is driven in parallel and is wired in series with its own series ballast inductor L6, L5, and L4, and capacitor C22, C30, and C32, forming a tank circuit. The drive frequency is set at near resonance. Before the lamp is struck, the inductor and capacitor of each lamp form a resonant circuit which ramps with the rise of POS DRV. Prior to striking, the current in the capacitor, and therefore the lamp filaments, is large and causes pre-heating. The resonant circuit insures lamp striking for all useful levels of lamp dimming. After striking, the lamp circuit is no longer resonant, and the filament current is determined by the impedance of the parallel capacitor and the voltage across the lamp. The values of inductors L4, L5, and L6 and capacitors C32, C30, and C23, and the drive frequency are selected to provide approximately 3.7 V AC (~400 mA) across each lamp filament when the lamp is at full brightness (lamp current ~210 mA). As the lamp is dimmed and the lamp current falls, the lamp voltage increases; therefore, the filament voltage increases with dimming.

The lamp half-bridge driver is formed by high-side switch HEXFET Q2, low-side switch HEXFET Q3, and resonant capacitor C27 at the lamp side of the bridge. The timing of the pulse signals supplied to the HEXFET gates from drivers U2 and U3 insures that there is an adequate "dead time" between the on-times of each HEXFET, i.e., where both switches are off. Capacitor C26 is included to form a resonant circuit with the collective inductance of ballast inductors L4, L5, and L6, in order to provide zero-voltage switching for both HEXFETs.

Capacitor C25 acts a filter for POS DRV. Resistor R30 is a bleeder resistor to discharge capacitor C25 when the power is off. Resistors R23 and R24 are series damping resistors for the HEXFET gates.

The DC1001 low-side driver U2 generates the periodic timing for the half-bridge lamp drive. This includes timing both for itself and for the DC1002 high-side driver U3. It also provides the drive signal for the gate of the low-side switch, HEXFET Q3.

Pin 8 $V_{DD}$ of low-side driver U2 is the driver bias supply voltage, +15 VDV. It is bypassed to ground by capacitor C21.

Pin 1 CT is the input for timing capacitor C22.

Pin 2 RT is the timing resistor input pin. Resistor R32 and trimmer R35 are connected in series from pin 2 to ground.

Pin 3 COM is the power return, and is connected to ground.

Pin 4 OUT provides the drive signal for the gate of low-side HEXFET Q3.

Pin 6 HD1 and pin 5 HD2 are control signal pins that provide the switching timing for the high-side driver U3. They are connected over the shortest possible circuit path to the corresponding pins on the high-side driver.

The DC1002 high-side driver U3 provides the drive signal for the gate of the high-side switch, HEXFET Q2. Its timing is controlled from the low-side driver U2 via the control inputs HD1 and HD2.

Pin 8 $V_{DD}$ of high-side driver U3 is the device bias supply voltage. This voltage is supplied from the bootstrap capacitor C24, which is charged from bias supply +15 VDV through "fast" blocking diode D8 and series resistor R31 when HEXFET Q3 is "on" and the high-side driver U3 is "off." This voltage is referenced to the node connecting the drain of HEXFET Q2 and the source of HEXFET Q3.

Pin 5 COM is the power return. It is connected to the node connecting the drain of HEXFET Q2 and the source of HEXFET Q3.

Pin 6 OUT provides the drive signal for the high-side switch, HEXFET Q2.

Pins 3 HD1 and pin 4 HD2 are control signal pins that provide the switching timing for the high-side driver. They are connected over the shortest possible circuit path to the corresponding points on the low-side driver U2.

Figure 6:
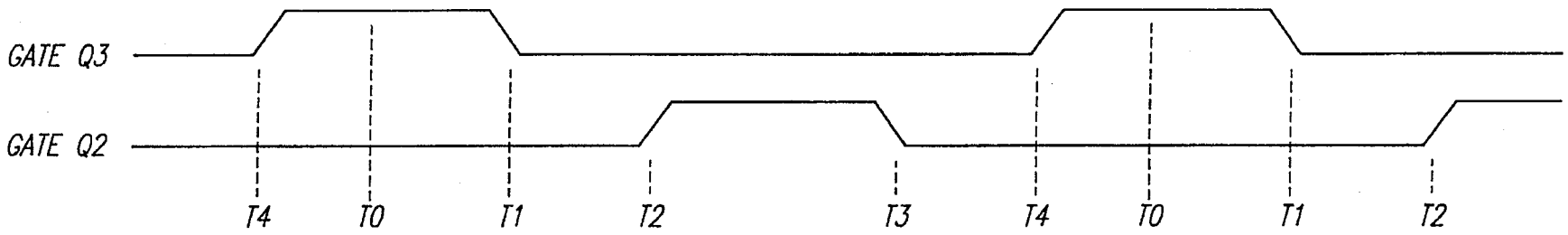
FIG. 6 shows a graph of the signals applied to the upper and lower switches by the upper and lower drivers in the FIG. 3 lamp driver section.

The sequence of operation for the zero-voltage switching of the output drivers is as follows, as shown in FIG. 6:

Step (a): To start, assume at $t_0$ that the high-side switch, HEXFET Q2, is "off" and the low-side switch, HEXFET Q3, is "on." Current is being sourced from capacitor C27 through HEXFET Q3 to ground. The voltage across the resonant capacitor C26 and HEXFET Q3 is approximately zero.

Step (b): At time $t_1$, $t_1>t_0$, HEXFET Q3 is turned "off" while HEXFET Q2 is held "off." While HEXFET Q3 is turned "off," the voltage across it is zero. Current that was passing through HEXFET Q3 is now diverted to capacitor C26. Time $t_1$ marks the start of the first switching "dead time." The voltage at the node of the drain of HEXFET Q2 and the source of HEXFET Q3 tries to quickly rise above the value of POS DRV. This is due to the resonant circuit formed by capacitor C26 and the collective inductance of the drive circuits. However, the voltage at capacitor C26 is clamped at POS DRV+$V_{diode}$ by the parasitic "drain to source" diode of HEXFET Q2. At this point, the end of the first dead time, the voltage across HEXFET Q2 is zero.

Step (c): Time $t_2$, $t_2>t_1$, is the end of the first dead time. At this point, HEXFET Q2 may be switched "on." Current is now sourced from POS DRV to the lamps B1, B2 and B3, via capacitor C27.

Step (d): At the end of the high-side drive interval $t_3$, $t_3>t_2$, HEXFET Q2 is "off" and the voltage across HEXFET Q2 is still zero. HEXFET Q2 may be turned "off." Time $t_3$ is the start of the second dead time. Current that is flowing in the ballast inductors is flowing from the node of the drain of HEXFET Q2 and the source of HEXFET Q3. At time $t_3$, this current is sourced from capacitor C26. The resonant circuit now tries to force the voltage at capacitor C26 below ground. However, as it passes below ground, it is clamped at ground $-V_{diode}$ by the parasitic diode between the source and drain of HEXFET Q3.

Step (e): Time $t_4$, $t_4>t_3$, marks the end of the second dead time. At this point, voltage across capacitor C26, and HEXFET Q3, is approximately 0 V and with HEXFET Q2 held "off," HEXFET Q3 now may be turned "on" with zero voltage across it from the source to drain. At this point, the circuit is back at the condition of operation at $t_0$ and the sequence repeats periodically.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

What is claimed is:

1. A ballast circuit, comprising:

(a) input power means for receiving a line AC signal as an input and providing a DC signal as an output;

(b) pre-regulator means for conditioning the DC signal, including a transformer with an input winding, an output winding, and a current sense winding, the input winding receiving the DC signal as an input, the output winding being connected in a flyback configuration with a flyback blocking diode, a bulk storage capacitor, and an output terminal for the conditioned DC signal, and the current sense winding including means for generating a current level signal proportional to the level of the transformer current;

switching means for controlling the transformer current, the switching means including an input terminal connected to the transformer input winding, an output terminal connected to ground, and a gate terminal;

a resonant capacitor connected between the switching means input terminal and ground, the resonant capacitor and the transformer forming a resonant circuit; and controller means for actuating the switching means, the controller means receiving as an input the current level signal and generating as an output a pulse voltage to the gate terminal of the switching means, the controller means actuating the switching means at a predetermined time after the current level signal indicates zero transformer current, coinciding with the timing of the resonant circuit such that the switching means turns on when there is zero voltage across the switching means; and (c) lamp driver means for receiving the conditioned DC signal as an input and for driving a gas discharge lamp load.

2. A ballast circuit according to claim 1, wherein the controller means further includes means for regulating the voltage of the conditioned DC signal, including:

means for receiving the current level signal as an input and for generating as an output a voltage level signal proportional to the voltage of the conditioned DC signal;

means for comparing the voltage level signal to a reference voltage; and means for shutting down and restarting the controller means when the voltage level signal exceeds the reference voltage.

3. A ballast circuit according to claim 2, wherein the controller means further includes dimming means for varying the voltage of the conditioned DC signal, including:

means for receiving as an input a dimming voltage signal indicating the desired level of dimming;

means for generating a second voltage level signal proportional to the voltage of the conditioned DC signal;

means for comparing the dimming voltage signal with the second voltage level signal; and means for adjusting the on-time of the controller output pulse voltage based upon the results of the comparison.

4. A ballast circuit according to claim 3, wherein the input power section includes:

input means for receiving the AC line signal;

rectifier means for rectifying the line signal;

output means for generating as an output the rectified, unfiltered line signal;

filtering means for filtering the line signal; and output means for generating as an output the rectified, filtered line signal.

5. A ballast circuit according to claim 4, wherein the controller means further includes means for providing a fine power factor correction to the conditioned DC signal, comprising:

means for receiving as an input the rectified, unfiltered line signal; and means for providing a shorter on-time for the controller output pulse voltage at the peak of the signal, and a longer on-time at the valley of the signal.

6. A ballast circuit according to claim 5, wherein the pre-regulator means further includes means for developing a current overflow signal proportional to the switching means current, and wherein the controller means further includes means for comparing the current overflow signal with an internal reference signal; and means for shutting down and restarting the controller means when the current overflow signal exceeds the internal reference signal.

7. A ballast circuit according to claim 1, wherein the lamp driver section comprises:

upper and lower switching means, configured in a half-bridge inverter, for converting the conditioned DC signal into an AC signal, the upper and lower switching means each including input, output, and gate terminals, the input terminal of the upper switching means receiving as an input the conditioned DC signal, the output terminal of the upper switching means being connected to the input terminal of the lower switching means, and the output terminal of the lower switching means being connected to ground, a resonant capacitor connected between the input terminal of the lower switching means and ground, a ballast inductor connected between the output of the half-bridge inverter and the gas discharge lamp load, the resonant capacitor and the ballast inductor forming a resonant circuit, the actuation of the upper and lower switching means being timed in conjunction with the resonant circuit such that there is zero voltage across a switching means when it is actuated.

* * * * *